US005351954A

United States Patent [19]

Oursler et al.

[11] Patent Number: 5,351,954

[45] Date of Patent: Oct. 4, 1994

[54] MAGNETIC BALL CARRIER FOR A PINBALL GAME

[75] Inventors: Barry Oursler, Barrington; Zofia Bil, Chicago, both of Ill.

[73] Assignee: Williams Electronics Games, Inc., Chicago, Ill.

[21] Appl. No.: 79,074

[22] Filed: Jun. 16, 1993

[51] Int. Cl.[5] ..... A63F 7/34

[52] U.S. Cl. ..... 273/127 R; 273/121 A

[58] Field of Search ..... 273/118-125, 273/127

[56] References Cited

U.S. PATENT DOCUMENTS 4,373,725 2/1983 Ritchie ..... 273/121 A
4,840,375 6/1989 Lawlor et al. ..... 273/119 A X
4,848,748 7/1989 Krutsch .
5,158,291 10/1992 Biagi et al. .
5,186,462 2/1993 Biagi et al. .

*Primary Examiner*—Vincent Millin
*Assistant Examiner*—Raleigh W. Chiu
*Attorney, Agent, or Firm*—Rockey, Rifkin and Ryther

[57] ABSTRACT

The play feature of the invention includes an electromagnet mounted below the playfield on a reversible screw. The screw is rotated to propel the magnet along its length relative to the playfield. A pinball disposed on the playfield is attracted by the magnet such that the ball will be dragged across the playfield as the magnet is propelled by the screw. Optical switches are used to provide feedback to the game's microprocessor indicative of the status of the play feature. In the preferred embodiment, the game player attempts to strike the ball as it is dragged across the playfield to put the ball in play and create multiple ball play.

8 Claims, 2 Drawing Sheets

MAGNETIC BALL CARRIER FOR A PINBALL GAME

BACKGROUND OF THE INVENTION

The invention relates, generally, to pinball games and, more particularly, to an improved play feature for such games.

Pinball games typically consist of an inclined playfield supporting a plurality of play features such as targets, bumpers, ramps and the like. The player activates flippers mounted on the playfield to direct a ferromagnetic ball at desired play features thereby to score points and control play of the game.

As will be appreciated, the popularity of a manufacturer's line of pinball games depends on its ability to attract players to its games. To attract players, it is necessary for game designers to continuously create new and exciting play features. One type of play feature includes mechanisms for automatically moving the ball during game play. One such mechanism is disclosed in Krutsch, U.S. Pat. No. 4,848,748, consisting of a vertically disposed playfield having a magnet driven by a screw for moving the ball from the inclined playfield to the vertical playfield.

Thus, a new play feature for a pinball game is desired.

SUMMARY OF THE INVENTION

The play feature of the invention includes an electromagnet mounted below the playfield on a reversible screw such that as the screw is rotated the magnet is moved relative to the playfield. A ball disposed on the playfield in close proximity to the magnet will be attracted by the magnet such that the ball will be dragged across the playfield as the magnet is moved by the screw. Optical switches are used to provide feedback to the game's microprocessor indicative of the status of the play feature. In the preferred embodiment, the game player attempts to strike the ball as it is dragged across the playfield with another ball to put both balls in play and create multiple ball play.

DETAILED DESCRIPTION OF THE INVENTION

Figure 1:
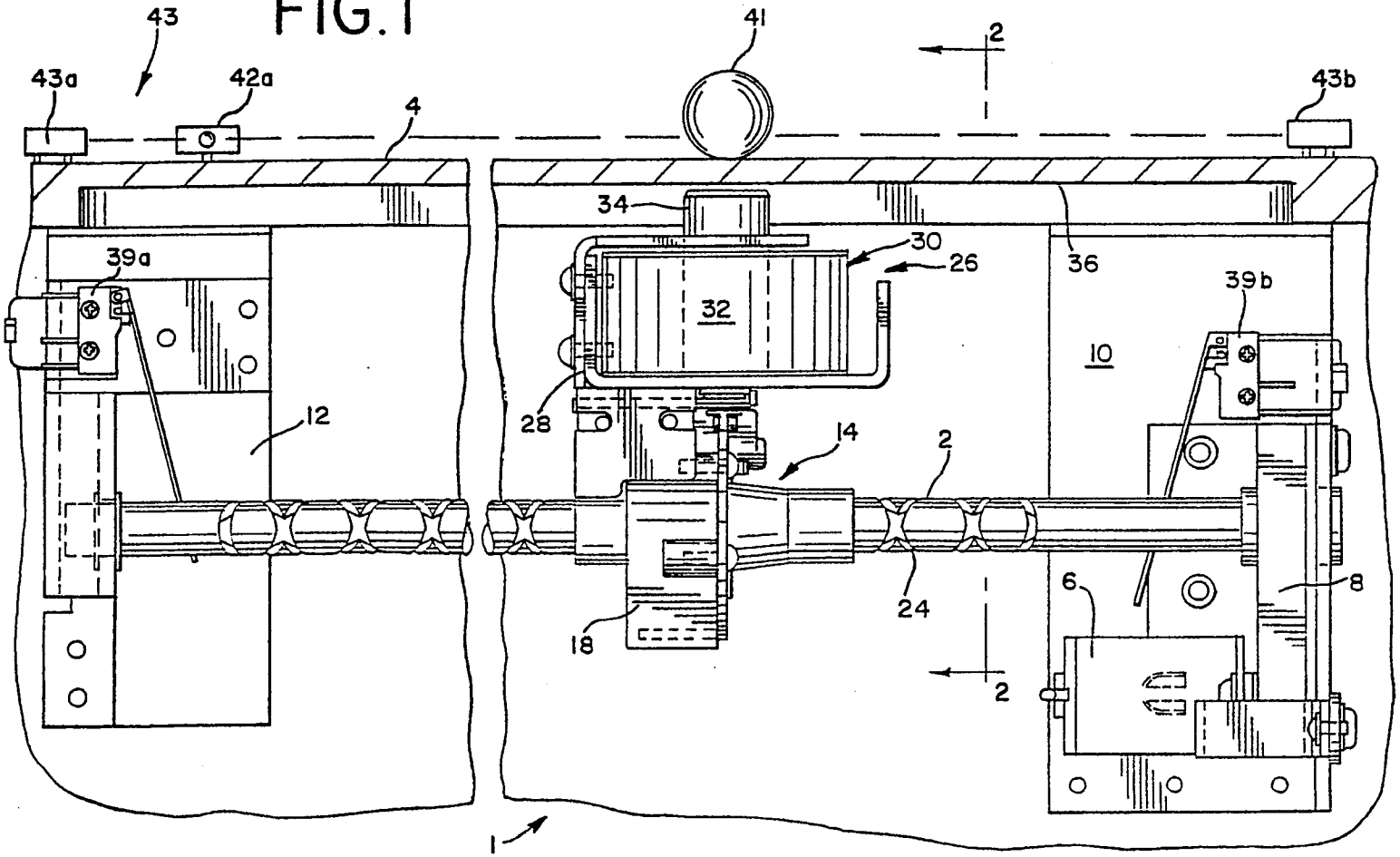
FIG. 1 is a side view of the play feature of the invention.

The play feature of invention, shown generally at 1, consists of a reversible screw 2 supported below the playfield 4. The screw 2 can be of any length, although in the preferred embodiment it extends for substantially the width of the game. The one end of screw 2 is driven by reversible electric motor 6, via gear reducer 8, and is connected to the underside of playfield 4 by bracket 10. The opposite end of screw 2 is rotatably supported in bracket 12 that is also connected to the underside of playfield 4.

Figure 2:
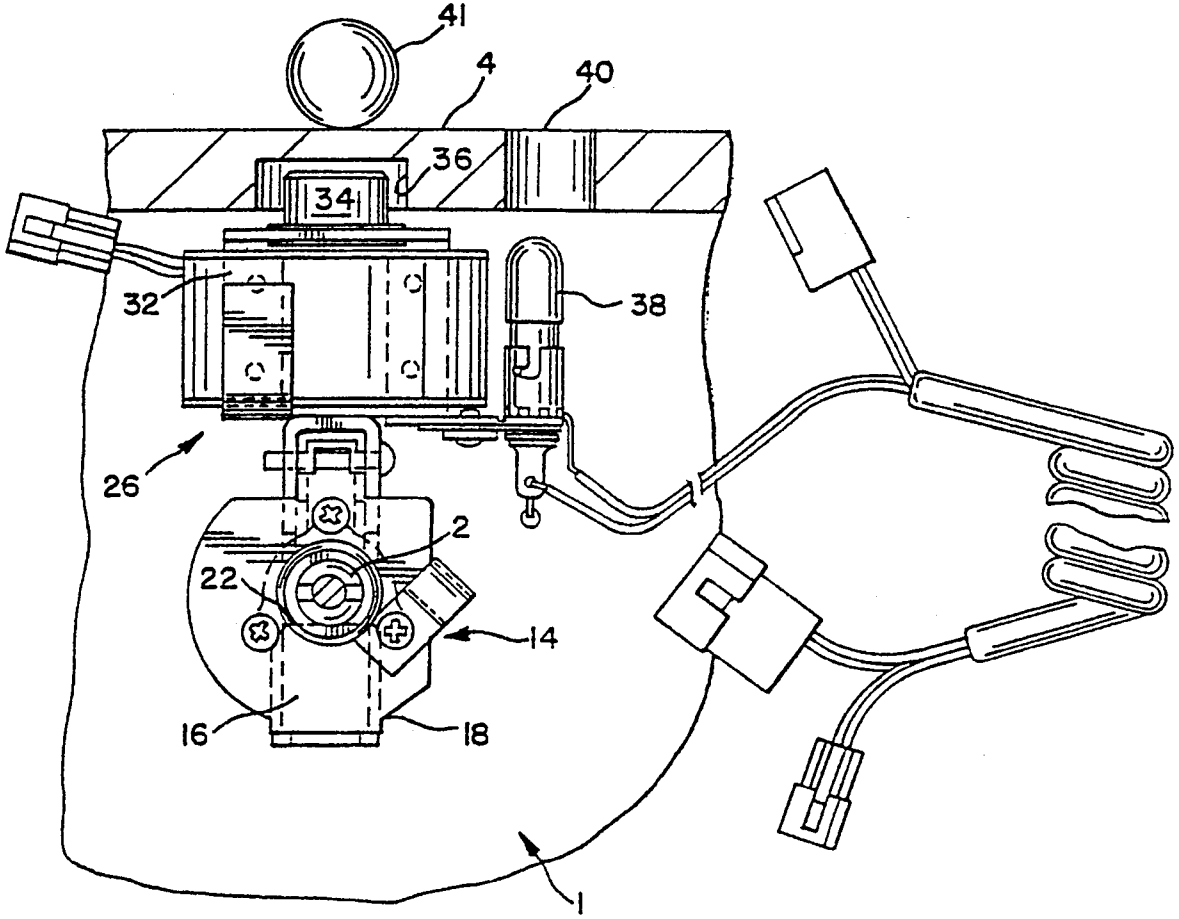
FIG. 2 is an end view of the play feature of FIG. 1.

A magnet carrier 14 is supported on screw 2 and includes a screw follower 16 supported in carrier body 18 as best shown in FIGS. 1 and 2. The follower 16 includes a projection 22 that engages the reversible screwthreads 24 formed on screw 4 such that as screw 4 is rotated by motor 6 carrier 14 will be moved linearly along screw 4. The carrier can be moved either left or right as viewed in FIG. 1 depending on the direction that screw 4 is rotated by motor 6. Limit switches **39*a* and 39*b* are provided at each end of the screw 2 to be contacted by the carrier 14 to provide a signal to the game microprocessor indicating that the carrier is at the end of travel of the screw. When such a signal is received the motor 6** is either turned off or reversed depending on the game program.

Mounted to carrier 14 is magnet assembly 26 consisting of a bracket assembly 28 supporting an electromagnet 30. Electromagnet 30 includes a coil 32 surrounding a core 34 such that when the coil is energized a magnetic force will be created in core 34. The core 34 extends into a slot or cut-out 36 formed in playfield 4 thereby to minimize the amount of material between the core and the upper surface of the playfield and maximize the effective force of the magnet on the ball.

Also mounted to bracket assembly 28 is a light 38 that moves with the carrier 14 (best shown in FIG. 2). A transparent window 40 is formed in the playfield above the light 38 such that when the light is turned on it will be visible to the player through the window.

Figure 3:
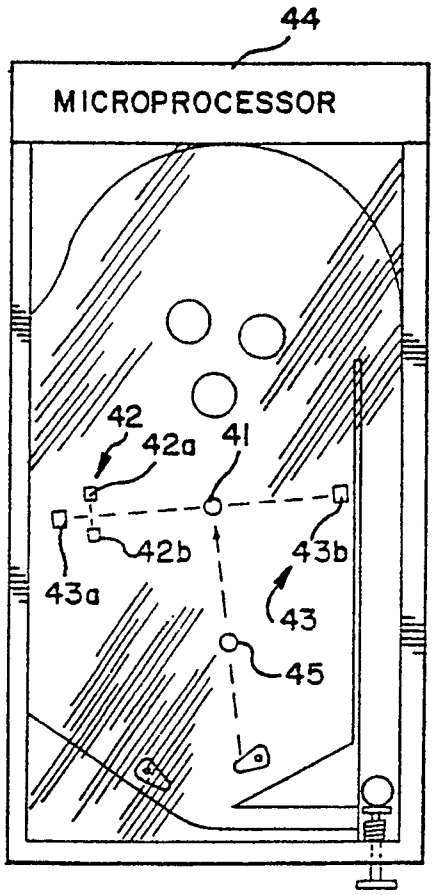
FIG. 3 shows the arrangement of the optical sensors on the playfield.

Referring to FIGS. 1 and 3, a pair of optical switches are provided on playfield 4 to determine the position of the ball with respect to the play feature. The first optical switch 42 is located at one end of the screw 4 and consists of a light source **42*a* and receiver 42*b*. The switch 42** detects the presence or absence of a ball at the home or start position.

The second optical switch 43 includes a light source **43*a* located on playfield 4 at a position corresponding to one end of the screw and a detector 43*b* located on the playfield at a position corresponding to the opposite end of the screw. As will be apparent, the light from source 43*a* extends along a path over playfield 4 that is coextensive with screw 2. The switch 43** is positioned to detect the presence or absence of a ball anywhere along its path of travel.

The signals from switches 39, 42 and 43 are provided to inform the game microprocessor 44 of the operating conditions of the play feature. The microprocessor, in response to these conditions and the rules of game play as defined by the software program, will control operation of the play feature. Specifically, the microprocessor can: 1) energize motor 6 to rotate screw 2 in either direction thereby moving carrier 14 in either direction; 2) energize the magnet 30 to hold and/or release a ball; and 3) energize the light 38 to provide a visible signal to the player.

The operation of the play feature will now be described with reference to FIGS. 1 and 3. Operation of the play feature begins with a ball 41 located in the home or start position at switch 42. The ball 41 is delivered to this position either automatically by a suitable microprocessor controlled mechanism or by the game player shooting the ball into this position during game play. Moreover, the ball 41 can be held in this position by magnet 30 or by another suitable mechanism. In this start position, switches 42 and 43 are both open (the ball interrupts the light from sources **42*a* and 43*a*) and motor 6** is inactive.

The play feature is initiated as determined by the game program. In the preferred embodiment, the play feature is initiated by the player completing a preselected game objective such as making a shot or series of shots. Once activated, the microprocessor will energize motor 6, magnet 30 and light 38. As a result, the carrier 14 will be moved under the playfield as screw 4 propels carrier 14 from left to right as viewed in FIG. 1. The magnet 30 will drag the ferromagnetic ball 41 across the surface of the playfield because of the attractive force between the core 34 and the ball. The window 40 will be illuminated by light 38 to provide a visual signal to the player of the ball's movement.

In a preferred embodiment, the game objective is to knock the ball 41 off of magnet 30 by striking it with a ball 45 that is already in play. If the player is successful in knocking the ball 41 off of magnet 30, multiple ball play will result where both the held ball 41 and the ball originally in play 45 are simultaneously in play. When the ball is knocked off of magnet 30, light from source 43*a* will reach detector 43*b* closing switch 43 and informing the game microprocessor that the player has successfully completed the play feature. The microprocessor in response thereto can increase scoring values or otherwise alter play of the game as determined by the game program. The closing of switch 43 also informs the microprocessor that magnet 30 should be returned to the home or start position and that another ball must be loaded onto magnet 30. Switch 42 insures that a ball is in the start position when play begins.

If the player does not successfully knock the ball 41 off of magnet 30, the magnet will drag the ball across the playfield 4 until carrier 14 contacts and closes switch 39*b*. The closing of switch 39*b* informs the microprocessor that the carrier has reached the end of travel while switch 43 informs the microprocessor that the ball was not knocked off the magnet. Depending on the game program, the carrier and ball can remain in the position at switch 39*b* until the player achieves another predetermined game objective or the motor 6 can be immediately reversed and the ball returned to the start position to give the player a second opportunity to knock the ball off the magnet.

While the invention has been described in detail, it will be appreciated that numerous changes in the details and construction of the invention can be made without departing from the spirit and scope of the invention as set forth in the appended claim.

What is claimed is:

1. A play feature for a pinball game having an inclined playfield supporting a plurality of other play features and a rolling ball, comprising:

a) an electromagnet adapted to be disposed adjacent the playfield so as to be able to magnetically hold a ball, said ball being in contact with said playfield;

b) means for moving the electromagnet relative to the playfield to drag the held ball across a path on the playfield; and c) means for determining the presence or absence of the ball on the magnet anywhere along said path.

2. The play feature according to claim 1, wherein said electromagnet is disposed below the playfield.

3. The play feature according to claim 1, wherein the means for moving includes a reversible screw driven by a reversible motor.

4. The play feature according to claim 1, wherein the means for determining includes at least one optical switch.

5. The play feature according to claim 1, further including means for knocking the held bal off of the magnet.

6. The play feature according to claim 5, wherein said means for knocking the held bal off includes another ball.

7. A play feature for a pinball game having an inclined playfield supporting a plurality of other play features and a rolling ball, comprising;

a) an electromagnet adapted to be disposed below the playfield so as to be able to magnetically hold a ball;

b) means for moving the electromagnet relative to the playfield to drag the held ball across a path on the playfield; ad c) means for determining the presence or absence of the ball anywhere along said path.

8. A play feature for a pinball game having an inclined playfield supporting a plurality of other play features and a rolling ball, comprising:

a) an electromagnet adapted to be disposed adjacent the playfield so as to be able to magnetically hold a first ball;

b) means for moving the electromagnet relative to the playfield to drag the first ball across a path on the playfield;

c) a second ball for knocking the first ball off of the electromagnet; and d) means for determining the presence or absence of the bal anywhere along said path.

* * * * *